United States Patent [19]

Lee et al.

[11] 3,944,151

[45] Mar. 16, 1976

[54] ALTERNATE SIDE WEB SPLICING APPARATUS

[75] Inventors: Frank X. Lee, New York; Leonard C. Krimsky, Spring Valley; Donald R. Freytag, Monroe, all of N.Y.

[73] Assignee: Worldwide Converting Machinery, Inc., Allendale, N.J.

[22] Filed: Feb. 3, 1975

[21] Appl. No.: 546,542

[52] U.S. Cl. ..... 242/58.3; 242/56 R

[51] Int. Cl.[2] ..... B65H 19/14

[58] Field of Search ..... 242/58.3, 58.1, 58.2, 58.4, 242/58.5, 56 R; 156/502

[56] References Cited

UNITED STATES PATENTS

| | | | |
|---|---|---|---|
| 1,843,470 | 2/1932 | Wood | 242/58.3 |
| 2,005,037 | 6/1935 | Johoncen | 242/58.3 |
| 2,963,235 | 12/1960 | Pedersen | 242/58.3 |
| 3,309,036 | 3/1967 | Anderson | 242/58.3 |

*Primary Examiner*—Edward J. McCarthy
*Attorney, Agent, or Firm*—Shenier & O'Connor

[57] ABSTRACT

The invention relates to an alternate side web splicing apparatus in which a bumper roll and a knife roll supported on a frame are adapted successively to be fired in the same direction from ready positions to perform an undersplice and in which means is provided for automatically changing the ready position of the knife roll while properly orienting the blade thereof and for firing the bumper roll and the knife roll in the opposite direction to perform an oversplice.

24 Claims, 6 Drawing Figures

188

2R1
1R1
M
2R2
1R2
5R1
190
PB3
5R2
2R3
1R3
PB1
1R
PB2
2R
3R3
S8
PB4
3R
3R1
9R1
3R2
S7
5R3
S1
192
5R
52
4R1
54
6R1
194
6R2
ARM DRIVE CONTROL
PB7
6R
196
48
200
TIMER
COUNT
1 2
198
74
7R1
S2
7R2
4R2
S3
4R3
S4
PB6
4R4
PB5
4R
8R
8R1
8R2
S5
9R
DEL.
202
8R3

ALTERNATE SIDE WEB SPLICING APPARATUS

BACKGROUND OF THE INVENTION

In continuous processes of treating or otherwise working with webs, it is necessary to splice the surface of a web carried by a new roll to the surface of the web leading from an expiring roll without interrupting the movement of the web to the installation at which operations are being performed thereon.

Apparatus is known in the prior art for automatically achieving the operation of splicing the surface of a new roll web to the surface of a web leading from an expiring roll. In apparatus of this kind, in the normal course of operations the web extends from the roll stand over a splicing unit bumper roll in its inactive position to a web tensioning system. To control the web tension the tensioning unit normally provides an output signal which is applied to a brake on the spindle of the roll being unwound. In preparation for a splicing operation, the roll-supporting turret is brought to a location at which a new roll is loaded onto a pair of empty arms on the turret. Next, the leading edge of the new web is torn to form a V therein at a predetermined location around the roll. Adhesive is applied to the surface of the web along the edge of the V and tear strips are used to hold this free edge down onto the remainder of the web. Next, the turret is moved in a direction to bring the new roll to a position at which it will be adjacent to the surface of the bumper roll of the splicing unit in its ready position. Next, the new roll is driven to bring it up to line speed. When this has been achieved, the operator notes the expiration of the web on the old roll and at a predetermined time operates a push-button to "fire" the bumper roll by pivoting it to bring the expiring web into contact with the web on the new roll. When that occurs, the new and old webs are adhered and the new web is caused to move along with the old web as the tear strips break. Shortly thereafter, a knife bar is swung from its ready position to an active position, in the course of which movement it severs the tail of the old web. The splice is now complete. Subsequently, the old roll is stopped, the tension system braking signal is applied to the new roll spindle, the bumper roll and knife bars return to their ready positions and the entire splicing unit is retracted.

Manufactured webs of paper, plastic and the like, are never identical on the two sides thereof. Moreover, as supplied by the manufacturer, the same side of the web always is in on the roll. In some web treating or assembling process of the prior art, it is desirable to work with one side of the web up, while in other processes it is desirable to work with the other side of the web up. Automatic splicing arrangements of the prior art generally are capable of performing only a splice of one type. That is to say they permit of use of an installation in which only one side of the web being unwound can be up. More particularly, there is known in the prior art, for example, an apparatus which is adapted to perform an undersplice, which is splicing the inner surface of the expiring web to the outer surface of the web on the new roll in an arrangement in which the inner surface of the web being unwound is up in the subsequent process. If it were desired to have the outer surface of the roll as applied by the manufacturer up in the process involved, it would be necessary to rewind the roll first in order to use this splicing apparatus, or in some manner invert the travelling web as it moved toward the process installation. While units capable of performing both an undersplice and an oversplice are known in the prior art, such units are cumbersome and changing over from an undersplice to an oversplice and vice versa with such units is a relatively complex operation.

We have invented an improved automatic web splicing apparatus which is adapted to perform either an undersplice or an oversplice. Our apparatus accomplishes this result which being less cumbersome than are alternate side splicing units of the prior art. Our apparatus may rapidly and expeditiously be changed from a condition in which it performs an undersplice to a condition in which it can perform an oversplice. It is relatively simple in construction for the results achieved thereby.

SUMMARY OF THE INVENTION

One object of our invention is to provide an improved automatic web splicing apparatus of the type which is adapted alternatively to perform an undersplice or an oversplice.

A further object of our invention is to provide an alternate side web splicing apparatus, which is less cumbersome than are alternate side splicers of the prior art.

A still further object of our invention is to provide an automatic splicing apparatus which accomplishes changeover from one direction of splicing to the other in a rapid and expeditious manner.

Yet another object of our invention is to provide an alternate side web splicing apparatus which is compact.

A still further object of our invention is to provide an alternative side web splicing apparatus, which is relatively simple in construction for the result achieved thereby.

Other and further objects of our invention will appear in the following description.

In general our invention contemplates the provision of an alternate side web splicing apparatus a frame is adapted to be swung from a retracted position to an operative position to permit a bumper roll and a knife roll carried by the frame to be fired successively in the same direction to perform an undersplice and in which automatic means is provided means changing the knife roll ready position and firing the bumper roll and knife roll successively in the opposite direction to perform an oversplice. As the knife roll is selectively moved to one of its two ready positions, the knife thereof is automatically oriented so that it will effectively sever the trailing edge of the old web as it moves from its ready to its active position.

BRIEF DESCRIPTIONS OF THE DRAWINGS

In the accompanying drawings which reference is made in the instance specification and in which like reference characters indicate the like parts in the various views.

FIG. 3 is a fragmentary top plan view of our alternate side web splicing apparatus, illustrating one side of the unit.

DESCRIPTION OF OUR PREFERRED EMBODIMENT

Figure 1:
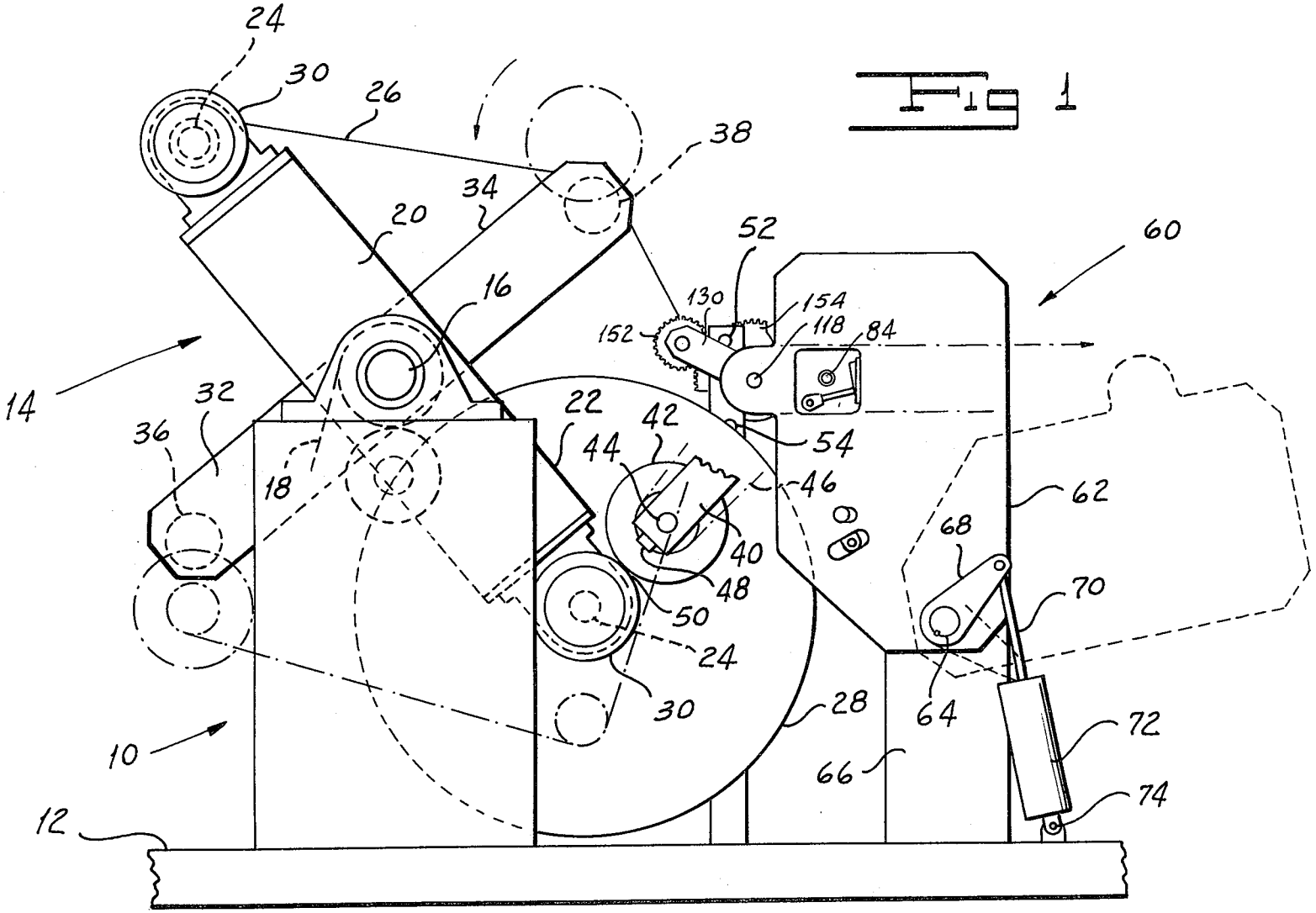
FIG. 1 is a side elevation of a web unwinding stand, provided with our alternate side web splicing apparatus.

Referring now to the drawings, our alternate side web splicing apparatus may be associated with a roll unwinding stand, indicated generally by the reference character 10, supported on a floor 12. The stand 10 rotatably carries a turret indicated generally by the reference character 14, having a shaft 16 adapted to be driven by any suitable drive, such as is indicated by the reference character 18.

The turret 14 includes two pairs of oppositely extending arms 20 and 22. Each pair of arms 20 and 22 carries a roll-supporting spindle 24. By way of example, the spindler 24 on arms 20 may support the roll carrying the expiring web 26, while the spindler 24 on arms 22, may support the roll carrying the fresh or new web 28. Preferably we provide each of the respective spindles 24 with a steel drum 30 at the end thereof. Turret 14 includes two other pairs of oppositedly extending arms 32 and 34 carrying respective idle rolls 36 and 38.

An arm 40 supported by means (now shown) carries a rubber drive roller 42 having a shaft 44 adapted to be driven by a suitable drive 26. As will more fully be explained hereinbelow, the arm 40 is adapted to be moved from a retracted position to a position at which the rubber roll 42 engages the drum 30 associated with the spindle carrying the new roll to drive the new roll up to speed in the course of a splicing operation. Further as will be explained more fully hereinbelow, a photocell 48 is adapted to be energized by a reflective strip on the drum 30 being driven to control the splicing operation. A mark 50 on the drum indicates the position of the reflective strip, so that the operator can prepare the leading edge of the new web at the proper location. In addition to the photocell 48, we provide two photocells 52 and 54, respectively positioned on a stanchion or the like adjacent to the stand 10 to sense the movement of a new roll into position for splicing in the course of an undersplice or an oversplice.

Our alternate side splicing unit indicated generally by the reference character 60, includes a frame 62 keyed to a shaft 64 supported on an upright 66, adjacent to the stand 10. A crank 68 carried by shaft 64 for rotation therewith is pivotally secured to a piston rod 70 associated with a cylinder 72 supported on a pivot 74. As will more fully be explained hereinbelow, cylinder 72 is adapted to be supplied with fluid under pressure selectively to move the unit 60 between an operative position indicating in full lines in FIG. 1 and an inoperative position indicated in broken lines in the Figure.

The unit 60 includes a bumper roll 76 carried by a shaft 78 supported in a pair of arms 80 at the sides of the splicing unit 60. Each arm 80 is carried by a hub 82 pivotally supported on a pivot shaft 84 carried by a pair of spaced frame members 86 and 88. Hub 82 is provided with a crank arm 100 extending upwardly into the space between a pair of stops 102 and 104 on the frame members 86 and 88. A pin 106 pivotally connects arm 100 at a point below the upper end thereof to a piston rod 108 associated with a double acting piston and cylinder assembly 110. This assembly 110 is swingably supported on a pin 112 extending between the frame members 86 and 88. We provide respective valves 114 and 116 connected to the interior of the cylinder 110 on the opposite sides of the piston head associated with rod 108. As will be more fully explained hereinbelow, each valve is adapted alternatively to connect the interior of the cylinder at one side of the piston to a source of fluid under pressure or to an exhaust. The arrangement we have shown enables the cylinder assembly 110 to act as an accumulator. That is to say, the operation of the device to fire the bumper roll the interior of the cylinder 110 at one side of the piston head may be at a pressure of, for example, 55 pounds per square inch, while the other side is at a pressure of 50 pounds per square inch. When the bumper roll is to fire the 50 pounds pressure is dumped and the bumper roll moves extremely rapidly into engagement with the surface of the web on the new roll.

The unit 60 includes a shaft 118, supported in respective bearings 120 and 122 on a frame member 124 and on the frame member 86. A bushing 126 on the shaft 118 rotatably carries the hub 128 of a lever, one arm, 130, of which supports one end of the knife roll 132 carrying the knife 133. It will readily be appreciated that a similar lever is provided for supporting the other end of the knife roll 132.

We connect the other arm 134 of the lever having the hub 128 to a piston rod 138 by means of a pin 136. Rod 138 forms a part of a single acting piston and cylinder assembly 140. Respective rollers 142 and 144 carried by the assembly 140 are received in brackets 146 and 148 on the frame members 86 and 124, swingably to support the assembly 140 for a reason which will more fully be understood from the description hereinbelow. A valve 150 is adapted to be operated to supply fluid under pressure to the interior of the assembly 140 to fire the knife roller in a manner to be described.

One end of the knife roller 132 carries a planet gear 152 for a rotation therewith, inboard of the lever arm 130. Each planet gear 152 is associated with a sun gear segment 154, carried by a hub 156 secured to the shaft 118. Sun gear arrangement 154 carries a pair of spaced stops 153 and 155 adapted to be engaged by an element 157 on arm 130. We form the hub 156 with an arm 158 which receives a pivot pin 160, carried by the upper ends of a pair of spaced crank arms 162 and 164. The lower ends of the crank arms 162 and 164 receive a crank pin 166, adapted to be driven by a pair of crank plates 168 and 170 secured to a pinion 172 carried by a shaft 174. A rack 176 associated with pinion 172 is secured to the movable cylinder 178 of a piston and cylinder assembly including a rod 180. We secure the rod 180 on which cylinder 178 rides between a pair of pins 182 and 184 on the frame 62. A valve 186 is adapted to be actuated to supply fluid under pressure to the interior of the cylinder 178 when it is desired to change the condition of the apparatus.

Figure 6:
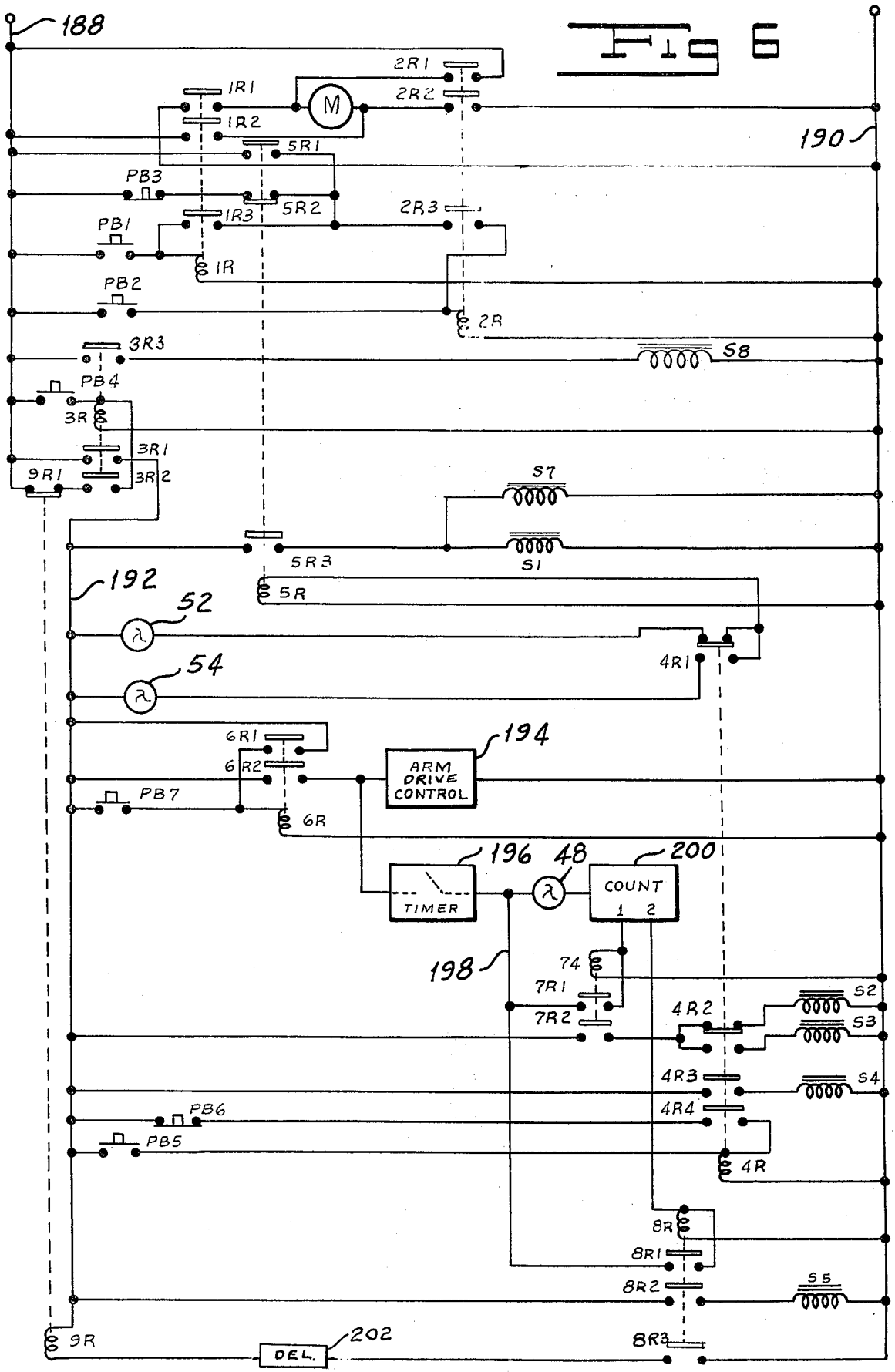
FIG. 6 is a schematic view of one form of control circuit, which may be employed in our alternate side web splicing apparatus.

Referring now to FIG. 6, we have shown one form of control circuit, which may be used to control the operation of our alternate side web splicing apparatus. Respective conductors 188 and 90 supply power to the circuit. In order to control the movement of the turret 14, we provide a drive motor M associated with the driving member 18. A push-button PB1 is adapted to be closed to energize the relay winding 1R to close a pair of normally open switch contacts 1R1 and 1R2, to cause the motor M to drive the turret 14 in one direction, such for example as in the clockwise direction.

To energize the motor M to drive the reel 14 in a clockwise direction, for example, the operator actuates a push-button PB1 to energize a relay winding 1R to close contacts 1R1 and 1R2 in the motor circuit and to provide a holding circuit for the relay through contact 1R3, a normal closed contact 5R2 and a stop push-button PB3. To energize motor M for driving the reel in the reverse direction, such for example as the counterclockwise direction, the operator actuates a push-button PB2 to energize a relay winding 2R to close two normally open switches 2R1 and 2R2 to energize the motor and to provide a holding circuit through switch 2R3, switch 5R2 and the stop push-button PB3. When the reel has arrived at the desired position, the operator opens the push-button switch PB3 to stop the reel.

The operation just described of driving the reel to a desired position is entirely under the control of the operator and depends upon the times at which he actuates the start and stop push-button. As will more fully be explained hereinbelow, when automatic operations are to take place during a splicing operation, contacts 5R1 are closed and contacts 5R2 are open. Under these conditions stopping of the reel drive automatically takes place upon the opening of the contacts 5R1.

Prior to initiating a splicing operation, the operator sets the system to perform an oversplice or an undersplice, as desired.

The circuit of FIG. 6 is shown in the condition at which the various elements are set to perform an undersplice. That is to say, a photocell 52, which is adapted to sense clockwise movement of the turret 14 in bringing a new roll into position adajcent to the bumper roll is connected in the circuit with winding 5R by a contact 4R1. At the same time, switch contacts 4R2 ready the circuit of a solenoid winding S2, associated with the valve which supplies fluid to the bumper roll cylinder to cause the bumper roll to move in a counterclockwise direction.

If it is desired to perform an oversplice, a pushbutton PB5 is operated to energize the winding 4R to move contact 4R1 downwardly to place photocell 54 in the circuit with winding 5R to move contact 4R2 down to ready a circuit of a solenoid S3, which operates the valve associated with the bumper cylinder to supply fluid thereto to cause the bumper roller to move in a clockwise direction. At the same time, winding R4 closes contacts 4R3 to supply fluid to the rack cylinder valve 186 and to complete its own holding circuit through contacts 4R4 and PB6. To return the system to the undersplice condition, it is only necessary to operate push-button PB6 to interrupt the holding circuit of winding 4R.

When a splicing operation is to be achieved and after the empty turret arms have been loaded in the manner to be described hereinbelow, the operator actuates a pushbutton PB4 to energize a relay winding 3R to close contacts 3R1 to apply power to a control circuit conductor 192. At the same time, contacts 3R2 close to provide a holding circuit for the winding 3R through normally closed switch contacts 9R1.

In the arrangement with which our alternate side splicer is used each pair of turret arms is provided with a let-off brake (not shown) which is adapted to be released upon energization of a solenoid. By way of example, in the circuit of FIG. 6 we have shown only the solenoid S8 associated with the arms carrying the full roll. Actuation of PB4 to energize winding 3R also closes a normally open switch 3R3 to energize solenoid S8 to release the brake associated with the full roll. It will readily be appreciated that a similar system is provided for the other set of arms.

When, as described hereinabove, power is applied to the line 192, one of the photocells 52 and 54 immediately completes the circuit of winding 5R to close contacts 5R1 to open contacts 5R2 and open contacts 5R3. The circuit is now ready for the splicing operation to proceed. The operator actuates PB1 to cause motor M to move in the clockwise direction to bring the fresh roll into position adjacent to the bumper roll. At the same time, the holding circuit for winding 1R is complete through now closed contacts 5R1. When the periphery of the new roll approaches to within a predetermined distance from the ready position of the bumper roll, the path of light to the photocell 52 is interrupted so that winding 5R is deenergized. When that occurs, contacts 5R1 open to interrupt the drive circuit of motor M. At the same time, contacts 5R3 close to energize the solenoid S1 to supply fluid under pressure to cylinder 72 to raise the splicing unit 60 to the ready position. In addition, closing of 5R3 energizes a solenoid S8 to supply fluid under pressure to the system (now shown) for raising arm 40 to a position at which wheel 42 engages the drum 30. When the operator observes that the roll being unwound has reached a predetermined condition of depletion, he operates a push-button PB7 to energize the winding 6R to close switch contacts 6R1 and 6R2. Closing of contacts 6R1 completes a holding circuit for winding 6R. Closing of the contact 6R2 energizes a conrol circuit 194 to energize the drive 46 of wheel 42, so that the new roll is driven up to line speed. At the same time, closing of contacts 6R2 energizes a timer 196, which, after a predetermined time, applies power to a conductor 198. Timer 196 provides a delay sufficient to ensure that the new roll is up to line speed. The next time the reflective strip 50 on the driven drum passes the photocell 48, a counter 200 produces an output pulse on a first channel to energize a relay winding 7R. Energization of this winding closes contacts 7R1 to complete a holding circuit for the winding 7R. In addition, contacts 7R2 close to energize either of the two solenoids S2 or S3 to cause the bumper roll to fire. On the next passage of the reflective strip past photocell 48, counter 200 puts out a pulse on a second channel to energize a winding 8R to close a switch 8R1 to complete its own holding circuit and to close 8R2 to energize solenoid S5 associated with the knife cylinder to cause the knife cylinder to fire the knife to sever the trailing edge of the web being exhausted. Energization of winding 8R also closes a switch 8R3, which, after a delay provided by a circuit 202, energizes a winding 9R to open switch contacts 9R1 to deenergize line 192. Circuit 202 provides sufficient delay to permit the knife roll to complete its stroke. When that occurs, arm 40 is retracted, the bumper roll is retracted, the knife is retracted, and the entire splicing unit 60 is moved to its retracted position. At the same time, signals may be provided to stop the roll being exhausted and to apply the tension-control braking signal to the spindle of the fresh roll.

It will readily be appreciated that various modifications can be made in the circuit of FIG. 6 within the scope of our invention. For example, we might modify the fluid circuit when setting the apparatus for the particular type of splicing operation to be performed and use only a single solenoid in place of the two solenoid S2 and S3 to fire the bumper roll.

In use of our apparatus in performing an oversplice, for example, the web 26 which is expiring is being unwound in a clockwise direction. Fluid under pressure is supplied to the cylinder 178 to move the cylinder to its upper limit position illustrated in full lines in FIG. 2. In this condition of the parts, sun gear segment 154 occupies the position shown in full lines at 154*a* in FIG. 2. At the same time, pinion 154 occupies the position indicated by the reference character 152*a*, with the knife blade 133a pointing generally downwardly. The operator first moves the empty arms 22 of the turret 14 to about the 9 o'clock position of FIG. 1, loads in a new roll and prepares it for splicing.

Figure 2:
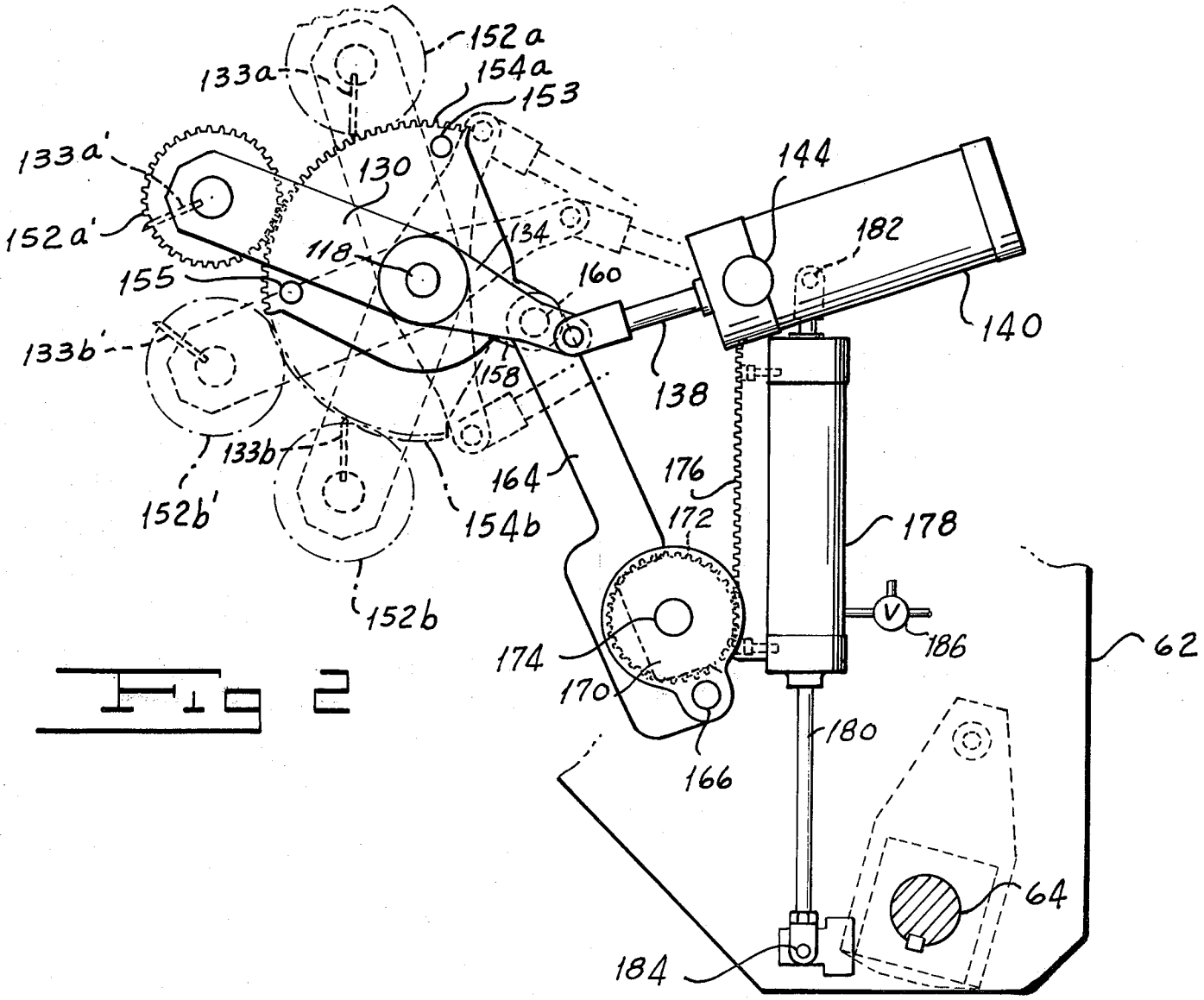
FIG. 2 is a side elevation of our alternate side web splicing apparatus, showing the various positions of the parts in performing an undersplice and in performing an oversplice.
Figure 5:
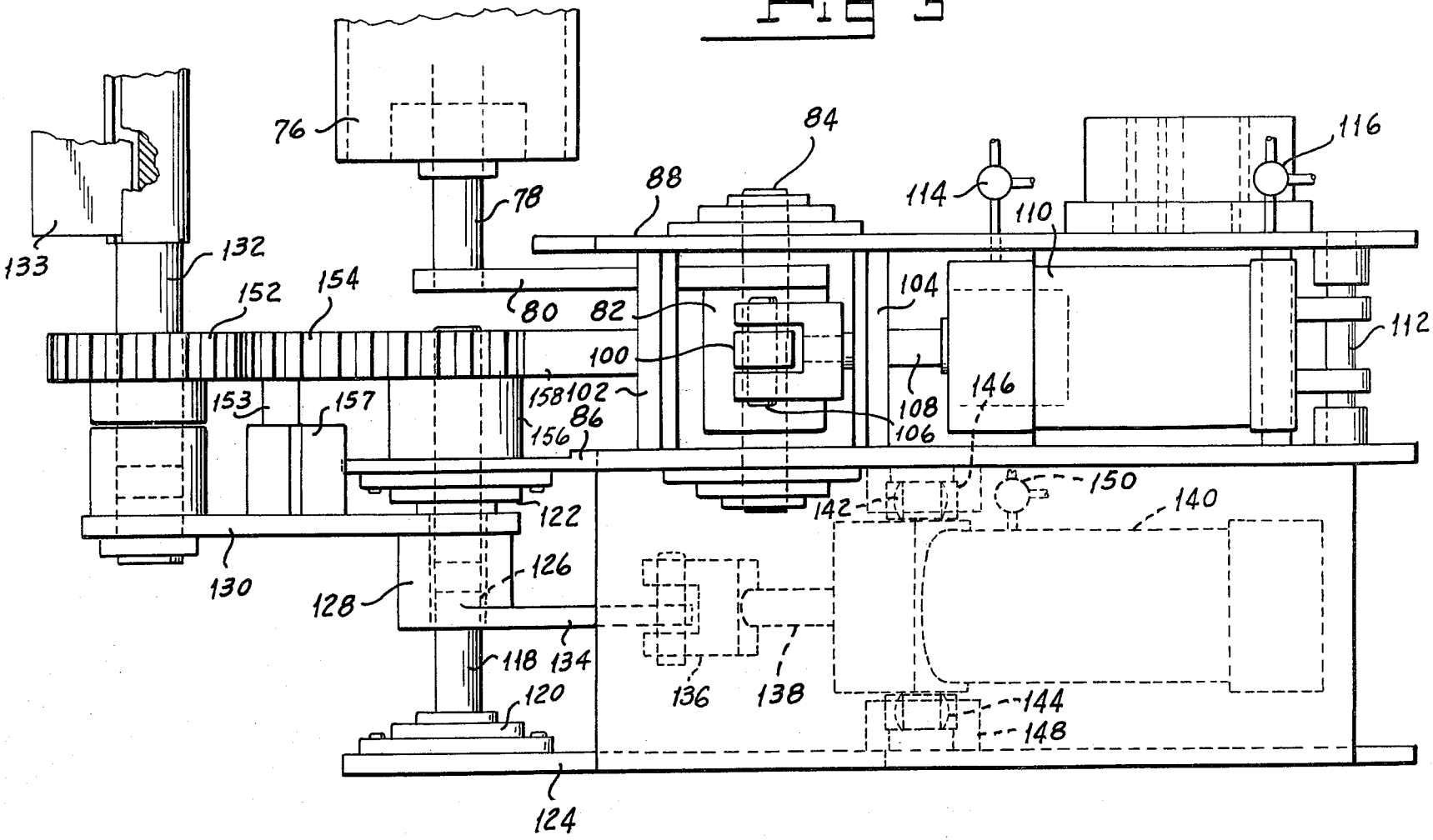
FIG. 5 is a fragmentary elevation illustrating a part of our alternate side web splicing apparatus.
Figure 4:
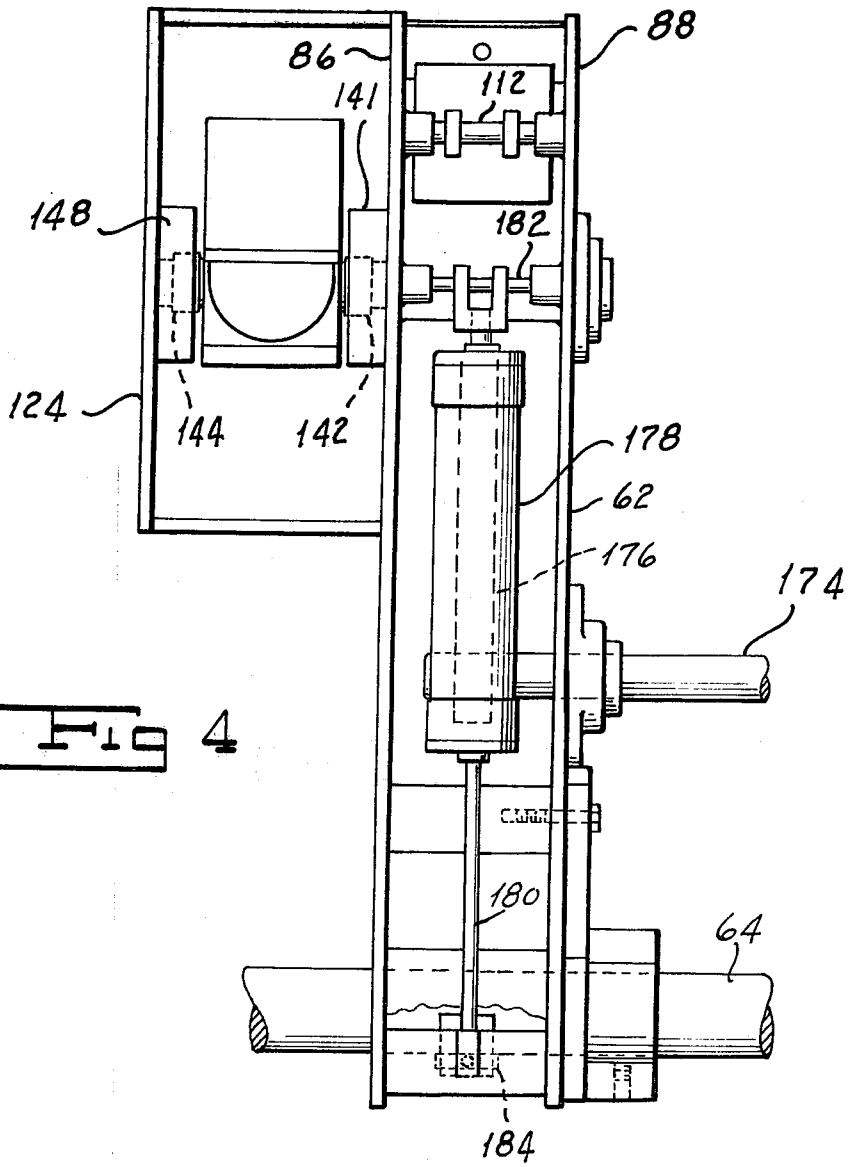
FIG. 4 is an end elevation of our alternate side web splicing apparatus.
Figure 5:
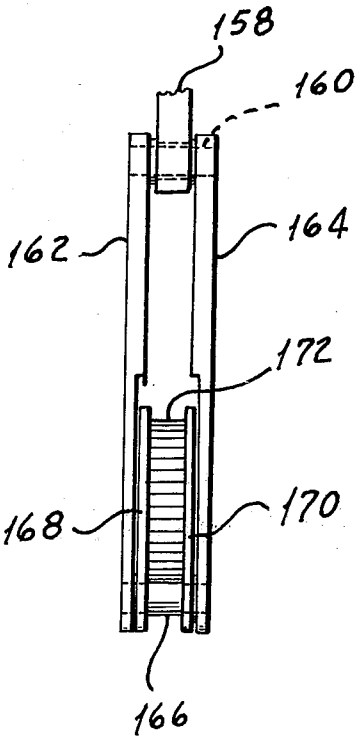

When the roll has been loaded and prepared, the associated brake is released and the turret is driven to move the new roll to the ready position indicated in full lines in FIG. 1. As it approaches the ready position at which its surface is a predetermined distance from the location of the bumper roll in the ready position, the turret automatically stops and the splicing unit 60 and wheel 42 move to the ready position. This operation is under the control of either photocell 52 or photocell 54. Next, the operator notes the fact that the splicing roll is becoming exhausted and presses push-button PB7. This operation drives the new roll up to line speed. A timer 196 provides sufficient delay to ensure the new roll is up to speed. As soon as the timer operates, photocell 48 notes the first passage of the reflective strip on drum 38 and fires the bumper roll 76. In performing an oversplice, fluid under pressure is supplied to the cylinder 110 in a direction to fire the roll in a counterclockwise direction to bring the old web into engagement with the surface of the new web. On the next passage of the reflective strip past photocell 48, the knife roll 132 is fired. This is achieved by supplying fluid under pressure to the interior of cylinder 140 to move rod 138 inwardly of the cylinder. When this is done, the arm 130 moves from the stop 153 toward the stop 155 to the position indicated in full lines in FIG. 2. As this occurs, pinion 152 rotates to the position indicated by the reference character 152*a* and the knife 133, correspondingly rotates to the position shown in FIG. 2 as 133*a*, in the course of which movement it cuts the tail of the expiring web. The splicing operation is now complete and the remaining operations are performed in the manner described hereinabove in connection with the showing of FIG. 6.

When our apparatus is being employed to perform an undersplice, the web is being unwound in a counterclockwise direction. In this instance, fluid under pressure is supplied to the interior of cylinder 178 to move the cylinder to the down position indicated in FIG. 2. As a result, crankpin 166 drives arms 162 and 164 to rotate the sun gear segment 154 to the position indicated as 154*b* in FIG. 2. This is a movement of the sun gear of approximately 90°. At the same time the pinion rotates to the 152*b* position indicated in FIG. 2 and knife 133 correspondingly rotates to a generally vertically upright position indicated as in 133*b* in FIG. 2.

To prepare for the splicing operation, the operator rotates the turret 14 in a counterclockwise direction to bring the empty arms 20 to the 9 o'clock position, loads the roll and prepares the roll end for splicing. Next, the turret is driven to bring the new roll into the ready position and the splicing assembly 60 is automatically raised to the ready position. When the operator notes that the expiring roll is very nearly depleted, he pushes button PB7 to bring the new roll up to line speed. When the roll is up to speed the timer 196 again operates and the first time photocell 48 senses the passage of the reflective strip on the drum 36, the bumper roll is fired. In this instance, fluid under pressure is supplied to the double-acting cylinder 110 in a direction to move the bumper roll in a clockwise direction to bring the expiring web into engagement with the surface of the new roll. On the next revolution of the new roll, photocell 48 signals the firing of the knife. As will be apparent from FIG. 2, to fire the knife for an undersplice, fluid under pressure is supplied to the cylinder 140 in the same direction as for an oversplice, so as to move rod 138 inwardly of the cylinder 140. In the course of this operation, pinion 152 moves to the 152*b*′ position and rotates the knife 133 from the 133*b* position to the 133*b*′ position, so that the knife passes through the web at the correct angular orientation to sever the trailing end of the expiring web. The splicing operation is now complete and the final operations are performed in a manner described hereinabove.

It will be seen that we have accomplished the objects of our invention. We have provided a web splicing unit which can rapidly and expeditiously be changed over to perform an undersplice or an oversplice. Our apparatus is less cumbersome than are alternate side splicers of the prior art. It is relatively simple in construction for the result achieved thereby.

It will be understood that certain features and subcombinations are of utility and may be employed without reference to other features and subcombinations. This is contemplated by and is within the scope of claims. It is further obvious that various changes may be made in details within the scope of the claims without departing from the spirit of the invention. It is, therefore, to be understood that the invention is not to be limited to the specific details shown and described.

Having thus described my invention, what I claim is:

1. Automatic web splicing apparatus for splicing the outer surface of a new roll web alternatively to the under surface of an expiring roll web or to the upper surface of an expiring roll web including in combination, a face of an expiring roll web including in combination, a support, a bumper roll, means mounting said bumper roll on said support for movement between a ready position and first and second fired positions, a knife roll, a knife on said knife roll, means mounting said knife roll on said support for movement between first and second ready positions and for movement from said first and second ready positions to respective first and second fired positions, and means for selectively initially positioning said knife roll in one of said ready positions.

2. Apparatus as in claim 1 including means responsive to said knife roll moving means for producing a predetermined initial angular orientation of said knife.

3. Apparatus as in claim 1 in which said bumper roll mounting means mounts said bumper roll for swinging movement around an axis, and means adapted to be actuated alternatively to swing said bumper roll in one direction from its ready position to its first fired position to bring the upper surface of an expiring roll web into engagement with the outer surface of a new roll web or to swing said bumper roll in the opposite direction from its ready position to its second fired position to bring the under surface of an expiring roll web into engagement with the outer surface of a new roll web.

4. Apparatus as in claim 3 in which said bumper roll swinging means comprises a double acting piston and cylinder assembly.

5. Apparatus as in claim 1 in which said knife roll mounting means includes means mounting said knife roll for swinging movement between said first and second ready positions and for swinging movement from said ready positions to said respective fired positions, and means adapted to be actuated alternatively to swing said knife roll in one direction from said first ready position to said first fired position to sever the trailing edge of an expiring roll web from the under side thereof or to swing said knife roll in the opposite direction from said second ready position to said second fired position to sever the trailing edge of an expiring roll web from the upper side thereof.

6. Apparatus as in claim 5 in which said knife roll swinging means comprises a single acting piston and cylinder assembly.

7. Apparatus as in claim 5 in which said knife roll mounting means comprises means mounting said knife roll for rotary movement around a second axis spaced from said axis of swinging movement, and means responsive to said swinging movement of said knife roll for rotating said knife roll around said second axis in the direction of said swinging movement.

8. Apparatus as in claim 1 in which said bumper roll mounting means mounts said bumper roll for swinging movement around an axis, and means adapted to be actuated alternatively to swing said bumper roll in one direction from its ready position to its fired position to bring the upper surface of an expiring web into engagement with the outer surface of a new roll web or to swing said bumper roll in the opposite direction from its ready position to its second fired position to bring the under surface of an expiring roll web into engagement with the outer surface of a new roll web, and in which said knife roll mounting means includes means mounting said knife roll for swinging movement between said first and second ready positions and for swinging movement from said ready positions to said respective fired positions, and means adapted to be actuated alternatively to swing said knife roll in said one direction from said first ready position to said first fired position to sever the trailing edge of an expiring roll web from the under side thereof or to swing said knife roll in said opposite direction from said second ready position to said second fired position to sever the trailing edge of said expiring roll web from the upper side thereof.

9. Apparatus as in claim 8 in which said knife roller mounting means comprises means mounting said knife roll for rotary movement around a second axis from the axis of swinging movement of said knife roll, and means responsive to swinging movement of said knife roll between said first and second ready positions for angularly orienting said knife.

10. Apparatus as in claim 1 in which said knife roll mounting means includes an arm, means mounting said knife roll on said arm for rotary movement around a first axis, means mounting said arm for pivotal movement around a second axis spaced from said first axis, said means for selectively initially moving said knife roll including means adapted to be actuated to move said arm between limit positions corresponding to the respective ready positions of said knife roll, said apparatus including means responsive to movement of said arm for rotating said knife roll to produce a predetermined orientation of said knife.

11. Apparatus as in claim 10 in which said means for moving said arm and said means for rotating said knife roll comprise a sun gear segment mounted for movement on said knife roll for movement therewith and in engagement with said sun gear segment, and means adapted to be actuated to move said sun gear between limit positions corresponding to the ready positions of said knife roll.

12. Apparatus as in claim 11 in which said means for moving said knife roll from said ready positions to said fired positions comprises second means for rotating said arm to roll said planet gear along said sun gear segment.

13. Apparatus as in claim 12 in which said second means for rotating said arm comprises a single acting piston and cylinder assembly including a piston rod and means pivotally connecting said piston rod to the end of said arm remote from said knife roll.

14. Apparatus as in claim 13 including means supporting said piston and cylinder assembly for pivotal movement on said frame.

15. Apparatus as in claim 11 in which said sun gear moving means comprises a crank, means mounting said crank for rotary movement on said support, a connecting rod for coupling said crank to said sun gear segment, and means for driving said crank.

16. Apparatus as in claim 15 in which said crank driving means comprises a pinion, a rack in engagement with said pinion, a stationary piston rod, a cylinder mounted for movement along said rod and means mounting said rack on said cylinder.

17. Apparatus as in claim 1 in which said bumper roll mounting means comprises an arm rotatably supporting said bumper roll, means mounting said arm on said support for pivotal movement around an axis and means including a double acting piston and cylinder arrangement for pivoting said arm.

18. Apparatus as in claim 1 in which said bumper roll mounting means comprises an arm, means mounting said bumper roll on said arm for rotary movement around a first axis, means mounting said arm on said support for pivotal movement around a second axis spaced from said first axis, said apparatus including a frame, and means mounting said support on said frame for pivotal movement between an inactive position and an active position, said first axis describing a generally horizontal arc as said support moves between said active and inactive positions.

19. Apparatus as in claim 1 in which said bumper roll mounting means comprises a first arm, means mounting said bumper roll for rotary movement on said first arm, and means mounting said first arm on said support for pivotal movement around an axis, and in which said knife roll mounting means comprises a second arm, means mounting said knife roll for rotary movement on said second arm, means mounting said second arm on said support for pivotal movement around an axis, a sun gear segment, means mounting said sun gear segment on said support for pivotal movement around said second arm axis and a planet gear carried by said knife roll for movement therewith, said planet gear being in engagement with said sun gear segment, and in which said means for initially positioning said knife roll comprises means for moving said sun gear segment between limit positions corresponding to the ready positions of said knife roll, said apparatus including means for actuating said first arm to move said bumper roll from its ready position in one direction to its first fired position in the course of an undersplicing operation and to move said bumper roll from its ready position in the other direction to its second fired position in the course of an oversplicing operation, and means for actuating said second arm to move said knife roll from its first ready position in said one direction to its first fired position in the course of an undersplicing operation and to move said knife roll from its second ready position in said other direction to its second fired position in the course of an oversplicing operation.

20. Apparatus as in claim 19 in which said first arm actuating means comprises a double acting piston and cylinder assembly.

21. Apparatus as in claim 19 in which said second arm actuating means comprises a single acting piston and cylinder assembly.

22. Apparatus as in claim 21 in which said first arm actuating means comprises a double acting piston and cylinder assembly.

23. Apparatus as in claim 22 in which said segment moving means comprises a crank, means mounting said crank for pivotal movement on said support, a connecting rod coupling said crank to said segment, a pinion secured to said crank for movement therewith, a rack in engagement with said piston, a stationary piston rod, a cylinder mounted for movement on said rod and means mounting said rack on said cylinder for movement therewith.

24. Apparatus as in claim 19 in which said first and second arm axes are coincident.

* * * * *

UNITED STATES PATENT OFFICE

CERTIFICATE OF CORRECTION

Patent No. 3,944,151 Dated March 16, 1976

Inventor(s) Frank X. Lee, Leonard C. Krimsky and Donald R. Freytag

It is certified that error appears in the above-identified patent and that said Letters Patent are hereby corrected as shown below:

Column 8, lines 44 and 45, delete "a face of an expiring roll web including in combination,";

Column 9, line 50, "edge" should read -- end --.

Signed and Sealed this twenty-fifth Day of May 1976

[SEAL]

*Attest:*

RUTH C. MASON
*Attesting Officer*

C. MARSHALL DANN
*Commissioner of Patents and Trademarks*